United States Patent [19]

Nakata

[11] Patent Number: 4,780,683

[45] Date of Patent: Oct. 25, 1988

[54] SYNCHROTRON APPARATUS

[75] Inventor: Shuhei Nakata, Amagasaki, Japan

[73] Assignee: Mitsubishi Denki Kabushiki Kaisha, Japan

[21] Appl. No.: 56,781

[22] Filed: Jun. 2, 1987

[30] Foreign Application Priority Data

Jun. 5, 1986 [JP] Japan ..... 61-129102
Jul. 4, 1986 [JP] Japan ..... 61-158546

[51] Int. Cl.[4] ..... H05H 13/04

[52] U.S. Cl. ..... 328/235; 328/228; 315/5.42

[58] Field of Search ..... 328/233, 235, 230, 229, 328/228; 313/62; 315/5.41, 5.42

[56] References Cited

U.S. PATENT DOCUMENTS

| | | | |
|---|---|---|---|
| 3,333,142 | 7/1967 | Takeda et al. | 315/5.41 |
| 3,412,337 | 11/1968 | Lothrop | 328/233 |
| 3,952,255 | 4/1976 | Passow | 328/233 |
| 4,623,847 | 11/1986 | Anderberg et al. | 313/62 X |
| 4,737,727 | 4/1988 | Yamada et al. | 328/235 |

FOREIGN PATENT DOCUMENTS

| | | | |
|---|---|---|---|
| 25999 | 11/1965 | Japan | 328/233 |
| 499692 | 10/1976 | U.S.S.R. | 328/235 |
| 782721 | 10/1981 | U.S.S.R. | 328/233 |

OTHER PUBLICATIONS

"RF System for Slac Storage Ring" 1971 pp. 253–254 IEEE Transactions ns–18.

"Theoretical Aspects of the Behaviour of Beams in Accelerators and Storage Rings", CERN, Geneva, 1977.

"Design Study Note of Super SOR (A 1 GeV Electron Storage Ring for Intense Synchrotron Radiation)", ISSP, No. 19, Jan. 1984.

"Superconducting Racetrack Electron Storage Ring and Coexistent Injector Microtron for Synchrotron Radiation", ISSP, No. 21, Sep. 1984.

*Primary Examiner*—David K. Moore
*Assistant Examiner*—Michael Horabik
*Attorney, Agent, or Firm*—Leydig, Voit & Mayer

[57] ABSTRACT

A synchrotron apparatus comprising an RF accelerating cavity, a pair of bending magnets, a pair of focusing magnets, and a pair of defocusing magnets, respectively, for accelerating, bending, focusing, and defocusing the particle beam to accelerate and/or store the particle beam, and a beam-cooling high-frequency accelerating cavity for generating a high-frequency electromagnetic field of an even TM-mode number in relation to direction transverse to the particle beam to decrease energy dispersion of the particle beam. Further, the RF accelerating cavity in the synchrotron apparatus provides a fundamental-mode exciting unit for exciting a fundamental-mode electromagnetic field, a detector for detecting phase and strength of respective higher-mode electromagnetic fields other than the fundamental-mode electromagnetic field, and exciting means for exciting a higher-mode electromagnetic field which is in antiphase with and has the same strength as the detected higher-mode electromagnetic field in accordance with the result of the detection by the detector so as to weaken the strength of the detected higher-mode electromagnetic field.

5 Claims, 3 Drawing Sheets

SYNCHROTRON APPARATUS

BACKGROUND OF THE INVENTION

The present invention relates to a synchrotron apparatus for accelerating or storing particle beams.

The basic arrangement of a conventional synchrotron apparatus which has been disclosed, for example, in "Superconducting Racetrack Electron Storage Ring and Coexistent Injector Microtron for Synchrotron Radiation" of TECHNICAL REPORT of ISSP Ser. B No. 21, September 1984 by Yoshikazu Miyahara et al. is shown in FIG. 1. This synchrotron apparatus is composed of a loop-shaped vacuum chamber 7 through which a beam of charged particles passes, an RF accelerating cavity 2 for accelerating the electron beam, a pair of focusing magnets 3*a* for focusing the electron beam, a pair of defocusing magnets 3*b* for defocusing the electron beam, and a pair of bending magnets 4 for bending the electron beam. These components together form an electron storage ring. The electron beam accelerates along a balanced orbit 1 which is a closed orbit determined by the energy of the electron beam and the magnetic field intensities of the focusing magnets 3*a*, the defocusing magnets 3*b*, and the bending magnets 4. In the electron storage ring indicated by the balanced orbit 1, energy loss, which occurs from generation of synchrotron radiation at the moment the electrons are being bent, is replenished by the RF accelerating cavity 2 to continuously store electrons having a certain energy level. However, the energy levels of each electron disperse in an energy band having a certain width (called energy dispersion hereafter). How this energy dispersion is determined will be explained below.

The above energy dispersion can be thought of by converting the time of arrival of the electrons at RF accelerating cavity 2 to a phase of RF voltage. The phase at which radiation energy or the energy loss per one round of the electron is equivalent to an RF voltage or an acceleration of the electrons resulting from replenishment by the RF accelerating cavity 2, is represented by $\phi_0$. If the energy of an electron is higher than a standard level for some reason, the electron circles around an orbit outside of the balanced orbit 1. In this case, when the electron arrives at the RF accelerating cavity 2, it is in a slight phase lag condition, that is the phase angle is delayed more or less in regard to the phase $\phi_0$, so that the acceleration voltage becomes less than the energy loss from radiation. Accordingly, the energy of the electron gradually decreases every circulation. On the other hand, in case of an electron having less energy than the standard level, the inverse phenomenon occurs, whereby the energy of the electron is increased. Therefore in relation to the high-frequency phase, the electrons oscillate (synchrotron oscillation) around the standard phase $\phi_0$. Practically, however, since the radiation energy of the particle per circuit is in proportion to the square of the energy of the particle, a kind of damping is added to the above oscillation (synchrotron damping). Accordingly, the energy dispersion of the electrons in the ring is determined by the balance between the energy fluctuation of each electron from the synchrotron radiation and the synchrotron damping. As a result, the energy dispersion is in inverse proportion to the square root of the radius of curvature of the bending magnets 4.

As noted, in the synchrotron apparatus it is often necessary to make the energy dispersion as small (narrow) as possible. If the energy dispersion is large (wide) due to a small square root of the radius of curvature of the bending magnet 4 according to the prior art arrangement, the electron beam orbit expands to bring a diminution (decrease) in particle density because the beam path broadens, the beam cross section increases, and the beam length lengthens. Accordingly, this brings a decrease in collision frequency between particles in particle beam collision experiments. In order to overcome this drawback, it is necessary to store a very large current, and problems such as instability of the particle beam occurs. Further if the beam diameter increases, it is necessary to enlarge vacuum vessels through which the beam passes and to expand the effective magnetic field areas, causing increases in size of the total apparatus and creating problems in relation to cost and area used by the apparatus.

SUMMARY OF THE INVENTION

It is, accordingly, an object of the present invention to overcome the above problems by providing a synchrotron apparatus in which the energy dispersion of the particle beam can be very small.

In the synchrotron apparatus of the present invention, a high-frequency accelerating cavity for beam cooling which forms a high-frequency electromagnetic field of an even transverse magnetic (TM) mode number in relation to the transverse direction of the particle beam, is disposed on the closed orbit of the particle beam within the electron storage ring thereby enlarging the nearby dispersion function $\eta$ of the storage ring. The beam-cooling high-frequency accelerating cavity is rectangular having a longer side in a direction transverse of the particle beam.

In the synchrotron apparatus of the present invention, the beam-cooling high-frequency accelerating cavity decelerates high-energy electrons and accelerates low-energy electrons by exciting (generating) a high-frequency transverse electromagnetic (TEM) field of an even mode number to make it possible to reduce the energy dispersion. In the electron storage ring of the prior art, beam energy dispersion was determined by the balance between the synchrotron radiation damping and the synchrotron radiation excitation, and beam energy dispersion was about 0.1%. Here, the present invention, by noticing the characteristic that a beam orbit shifts slightly from the central orbit (the balanced orbit 1,) depending on the differences of beam energy thereof, it is arranged so that a decelerating action is imported to high-energy particles and an accelerating action to the low-energy particles, by means of passing the electron beam through a standing wave of the even TM mode number, e.g. $TM_{210}$-mode, where 2 is the number of half-period variations of the magnetic field along the longer transverse dimension, 1 is the number of half-period variations of the magnetic field along the shorter transverse dimension, and 0 is the number of half-period field variations along the axis. The beam cooling high-frequency acclerating cavity of the present invention is effective even in very high-frequency (1 GHz) applications and accordingly the whole apparatus can be reduced in size, and it also becomes possible to decrease the beam energy dispersion to about 0.01%.

DETAILED DESCRIPTION OF THE PREFERRED EMBODIMENTS

Figure 1:
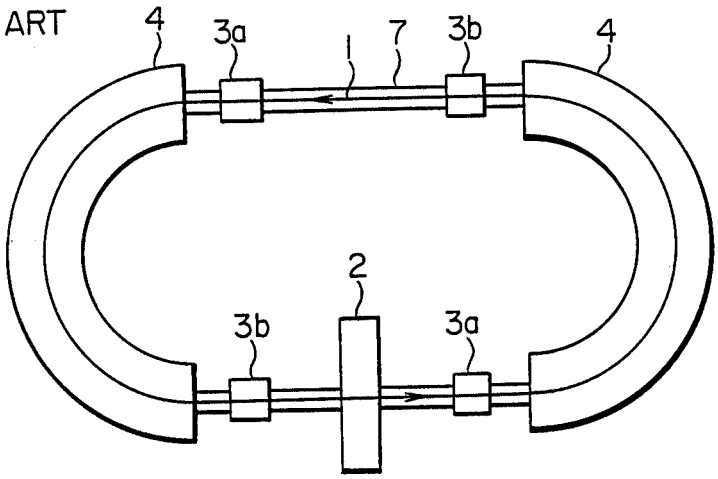
FIG. 1 PRIOR ART
FIG. 1 is a schematic diagram showing a construction of a conventional synchrotron apparatus.
Figure 2:
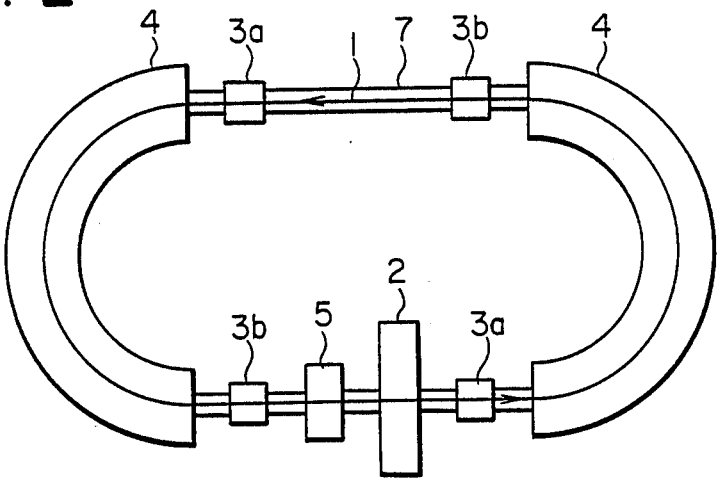
FIG. 2 is a schematic diagram showing a construction of a preferred embodiment of the synchrotron apparatus of the present invention.
Figure 3:
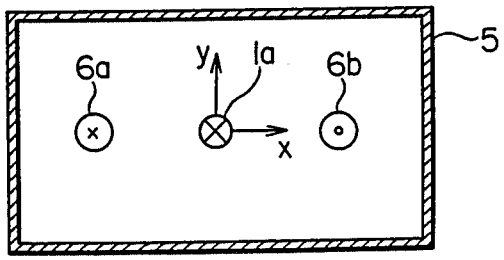
FIG. 3 is a vertical sectional view of the beam cooling high-frequency accelerating cavity for explaining the conditions therein.

As shown in FIG. 2, the synchrotron apparatus according to a preferred embodiment of the present invention comprises a loop-shaped vacuum chamber 7 through which a beam of charged particles 1 passes, an RF accelerating cavity 2, a pair of focusing magnets 3*a*, a pair of defocusing magnets 3*b* and a pair of bending magnets 4 for accelerating, focusing, defocusing and bending the beam, respectively, and further comprises a beam-cooling high-frequency accelerating cavity 5. Further, FIG. 3 is a sectional view of the beam-cooling high-frequency accelerating cavity 5 in the vertical direction of the beam, wherein the direction of progression of the beam is indicated at 1*a*, and directions of the high-frequency electric field of the $TM_{210}$-mode which is generated by the beam-cooling high-frequency accelerating cavity 5 are indicated at 6*a* and 6*b*, where 6*a* is at the inner side of the storage ring. Exciting antennas for exciting the TM-mode of the electromagnetic field of the RF accelerating cavity 2 and the beam-cooling high-frequency accelerating cavity 5 have been shown in the report, "RF System for Slac Storage Ring" on P.253–254 of IEEE Trans. NS-18, published in 1971.

Now the TM-mode and transverse electric mode will be briefly explained by considering a X, Y, Z three-dimensional space where the Z axis direction is defined as the progressive direction of the electromagnetic wave. In the present case, the progressive direction of the electromagnetic wave and the progressive direction of the electron beam are in the same direction. When E indicates the electric field and H indicates the magnetic field, $Ez \neq 0$, $Hz = 0$ in a TM-mode (e.g., an electromagnetic wave of which a Z axis direction component Hz of the magnetic field is zero), and in a TE-mode, $Ex = 0$, $Hz \neq 0$, (e.g., an electromagnetic wave of which a Z axis direction component Ez of the electrical field is zero). Regarding the TM-mode, the equation for Ez is:

$$\frac{\partial^2}{\partial x^2} Ez + \frac{\partial^2}{\partial x^2} Ez + \frac{\partial^2}{\partial x^2} Ez + K^2 Ez = 0 \qquad (1)$$

Figure 4:
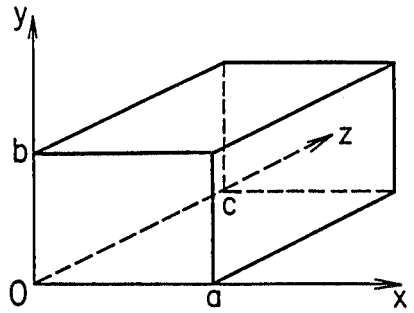
FIG. 4 is a graph showing a X, Y, Z three-dimensional space in a rectangular solid for explaining the TM-mode.

Now a TM-mode wave in a rectangular solid as shown in FIG. 4 will be considered. The boundary conditions of the Z axis direction component Ez of the electrical field are as follows:

when $X = 0, a \quad Ez = 0;$
when $Y = 0, b \quad Ez = 0;$
when $Z = 0, c \quad dEz/dz = 0;$ and accordingly, by expanding HQ. (1), the Z axis direction component Ez is shown as follows:

$$Ez = \sum_l \sum_m \sum_n Ez, lmn \sin l \cdot \pi \cdot \frac{X}{a} \sin m \cdot \pi \cdot \frac{Y}{b} \cos n \cdot \pi \cdot \frac{Z}{c} \qquad (2)$$

In EQ. (2), l, m, n are called mode numbers and an electromagnetic wave generated in the pertinent mode is called TM l, m, n-mode. FIGS. 5A, 5B, 5C and 5D show conditions of component Ez in the Z axis direction of the $TM_{110}$-mode, the $TM_{210}$-mode of the preferred embodiment, the $TM_{120}$-mode and the $TM_{111}$-mode, respectively. The mode numbers l, m, n are related to the X, Y, Z directions, respectively, and they indicate the number of maximum and minimum value points (peaks) of strength of the electromagnetic wave between "0" and "a", "0" and "b", "0" and "c" respectively. Accordingly, a $TM_{310}$-mode, for example, would have an Ez component with three peaks between "0" and "a" in relation to the X direction and one peak between "0" and "b" in relation to the Y direction.

Now the action of the electrons in the storage ring will be considered. In the beam-cooling high-frequency accelerating cavity 5, the high-energy electrons (particles) pass through on orbits outside of the central orbit 1, and the low-energy electrons pass through on orbits inside of central orbit 1. The beam-cooling high-frequency accelerating cavity 5 excites the $TM_{210}$-mode which is shown in FIG. 5B. This $TM_{210}$-mode has a phase relationship with the decelerated particles (electrons) passing on the orbits outside of the central orbit 1 and the accelerated particles passing on the orbits inside of the central orbit 1 as shown in FIG. 3. Accordingly, since the high-energy particles are decelerated and the low-energy particles are accelerated, respectively by the RF voltage, the energy dispersion of the particles is therefore reduced to a lower level, making it possible to reduce the synchrotron apparatus in size. For instance, in the $TM_{210}$-mode, when the maximum electrical field strength is set up at 1 KV/cm, the energy dispersion becomes one-tenth of previous synchrotrons.

Further, though the above embodiment is for employment in an electron storage ring, the present invention is however not limited, however, to the above embodiment. The present invention is also practical for a free electron laser and an ion storage ring respectively, whereby the same effects may also be achieved. Furthermore, though the $TM_{210}$-mode was used in the above embodiment, the same result also can be obtained in the cases of using a $TM_{410}$-mode and $TM_{610}$-mode respectively.

Figure 6:
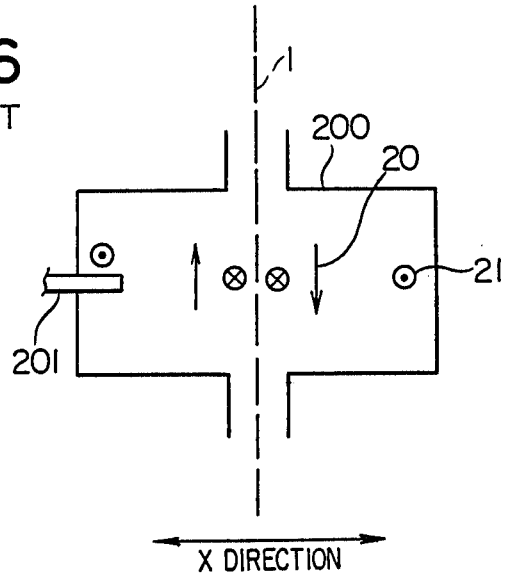
FIG. 6 PRIOR ART
FIG. 6 is a horizontal sectional view of an RF accelerating cavity in the prior art.

Further, FIG. 6 illustrates a horizontal sectional view of a conventional RF accelerating cavity 2, which is shown in Proceedings of the First Course of the International School of Particle Accelerators of the "Ettore Majorana" Center for Scientific Culture, Erice 10–22 November 1976 (CERN 77-13, 19 July 1977). In FIG. 6, the particle beam which is illustrated as the central orbit 1 passes through the center portion of the RF accelerating cavity 200. The RF accelerating cavity 200 provides a $TM_{110}$-mode absorbing antenna 201. In the RF accelerating cavity 200, the $TM_{110}$-mode occurs from the passage of the particle beam 1 in addition to the fundamental-mode.

Figure 5A:
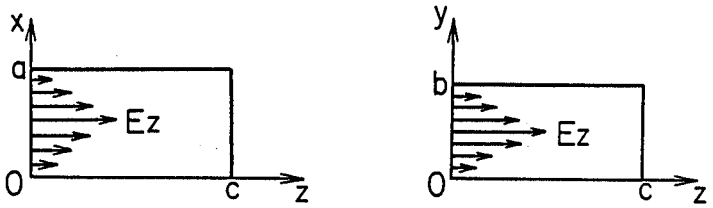
FIGS. 5A to 5D are graphs showing conditions along the Z axis component Ez in the respective TM-modes.
Figure 5B:
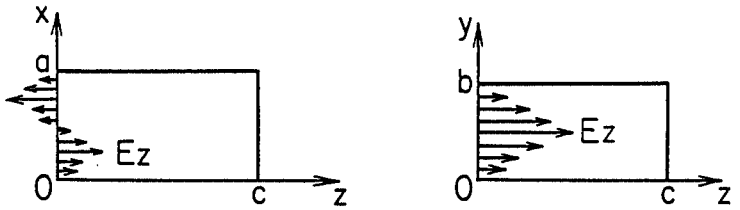
Figure 5C:
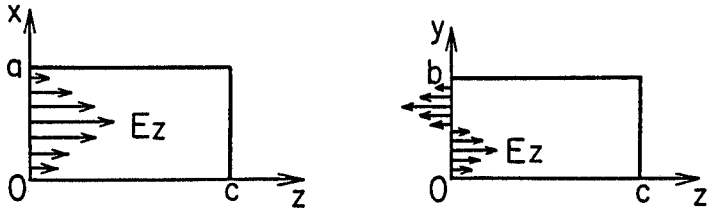
Figure 5D:
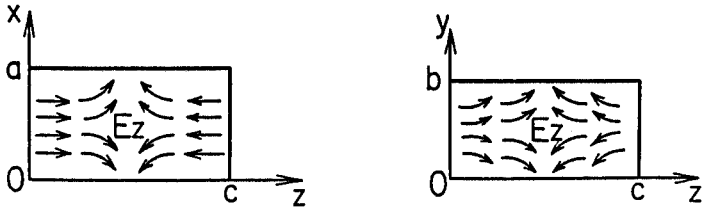

This $TM_{110}$-mode is different from the above $TM_{110}$-mode shown in FIG. 5A because of the method of expression. That is, this $TM_{110}$-mode is expressed based on a cylindrical coordinate. When the TM $\theta$, r, z-mode is used, the respective mode numbers $\theta$, r, z relate to the circumferential direction in the vertical-plane of the cylindrical coordinate (in the transverse-plane of the beam direction), the radial direction of the cylindrical coordinate, and the longitudinal direction of the cylindrical coordinate (the beam direction), respectively. They also indicate the respective numbers of peaks of the electromagnetic wave strength in the corresponding directions.

The directions of the electric-field vectors and the magnetic-field vectors of the $TM_{110}$-mode are indicated by numerals 20 and 21, respectively, in FIG. 6. In this moment, the particles receive a deflecting force (orbit deflection) in the X axis direction by the interaction against the magnetic field 21. In the case of a ring-form synchrotron apparatus, since the deflecting force in the X axis direction is imparted to the particles at every circulation thereof, the particles soon pass on orbits which are quite apart from the central orbit 1, strike against the inside wall surface, and then disappear.

To avoid the deflection of the particles, the $TM_{110}$-mode absorbing antenna 201 has been used in the prior art. The $TM_{110}$-mode absorbing antenna 201 has characteristics for weakening the $TM_{110}$-mode by converting the electromagnetic energy of the $TM_{110}$-mode into heat to stabilize the beam. The theory thereof being that, since the absorbing antenna 201 is disposed so that one part of the magnetic field of the $TM_{110}$-mode passes therethrough, the alteration of the magnetic field in this state produces an eddy current in the absorbing antenna 201 to produce heat by reason of the impedance of the absorbing antenna 201. That is the energy of the $TM_{110}$-mode is converted to heat.

However, in the RF accelerating cavity 200 of the prior art, for controlling the $TM_{110}$-mode, the absorbing antenna 201 must be inserted fairly deep in the cavity 200. Consequently there is a problem in that the absorbing antenna 201 influences the fundamental-mode.

A RF accelerating cavity of the present invention comprises a detecting means for detecting the phase and strength of higher-mode electromagnetic fields other than the fundamental-mode electromagnetic fields by detecting an electromagnetic field in the RF accelerating cavity, and excitation means for exciting a higher-mode electromagnetic field in the accelerating cavity, having an antiphase and the same strength in relation to the detected higher-mode electromagnetic field, in accordance with the result of the detection by the detecting means, whereby the strength of the above higher-mode electromagnetic field is weakened.

Figure 7:
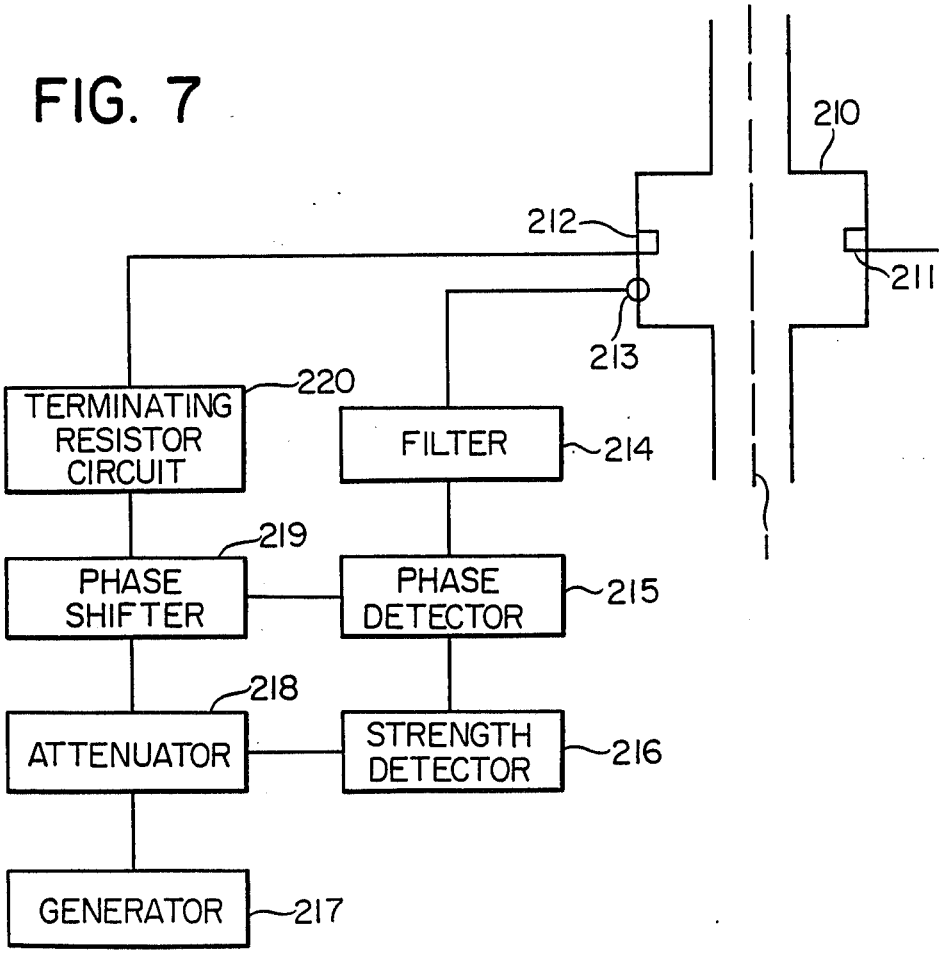
FIG. 7 is a schematic diagram showing the whole of the RF accelerating cavity of the present invention.

FIG. 7 illustrates a detailed constructional view of a preferred embodiment of the RF accelerating cavity in the present invention, as indicated by the numeral 2 in FIG. 2. In FIG. 7, the particle beam which is illustrated as the central orbit 1 passes through the center portion of the RF accelerating cavity 210. The RF accelerating cavity 210 comprises a fundamental-mode exciting antenna 211 for accelerating the beam (the RF accelerating cavity 200 in the prior art also being provided therewith but omitted in FIG. 6), an antiphase $TM_{110}$-mode exciting antenna 212 and search coil 213 for the high-frequency wave. A filter 214 for cutting the fundamental-mode electromagnetic fields, a phase detector 215 and a strength detector 216 are serially connected to the search coil 213. On the other hand, a generator 217 for exciting the antiphase $TM_{110}$-mode, an attenuator 218, a phase shifter 219 and a terminating resistor circuit 220 having an infinite impedance against the fundamental wave are connected serially, and the terminating resistor circuit 220 is further connected to the antiphase $TM_{110}$-mode exciting antenna 212. Further the phase detector 215 is connected to the phase shifter 219, and the strength detector 216 is connected to the attenuator 218. Also, a generating means (not shown) for driving the fundamental-mode exciting antenna 211 is connected thereto.

In operation, first, the $TM_{110}$-mode which is provided by reason of the beam current is sensed by the search coil 213, and the fundamental-mode component in a detected signal is cut off by the filter 214, and the phase and strength of the detected signal are further detected by the phase detector 215 and the strength detector 216, respectively. The phase shifter 219 regulates the phase of output of the generator 217 based on output of the phase detector 215 so that the exciting antenna 212 excites an electromagnetic wave having an antiphase to that of the $TM_{110}$-mode resulting from the beam current. Further the attenuator 218 regulates the output strength of the generator 217 so that it equals the output strength of the strength detector 216. Accordingly, since the antiphase $TM_{110}$-mode exciting antenna 212 excites an electromagnetic field having the same strength and in antiphase to the $TM_{110}$-mode in the cavity 210, it therefore becomes possible to eliminate the $TM_{110}$-mode in the cavity 210 positively, whereby the particle beam can be stabilized without affecting the fundamental-mode. Furthermore since the terminating resistor circuit 220 having infinite impedance against the fundamental wave is connected between the antiphase $TM_{110}$-mode exciting antenna 212 and the phase shifter 219, the generator 217 is not affected by the fundamental wave mode.

Further, although in the above preferred embodiment, the generator 217 for exciting the antiphase $TM_{110}$-mode and the generator (not shown) for exciting the fundamental-mode are provided separately, one generator may also be used for exciting the fundamental mode and the antiphase $TM_{110}$-mode in the present invention. In this case, the antiphase $TM_{110}$-mode is generated by way of modulating the fundamental mode.

Also, even though the above preferred embodiment was explained for a case in which the higher-mode other than the fundamental mode was the $TM_{110}$-mode, the present invention can also be practiced in cases where the higher mode is some other mode, with the same resulting effects.

Further it is possible to provide a plurality of the above systems to stabilize a plurality of modes.

Moreover, in the above preferred embodiment, a terminating resistor circuit having infinite impedance against the fundamental mode is inserted in series for keeping out the connection between the power supplies, however, it is possible to use a directional coupler or a circulator in place of the terminating resistor circuit.

What is claimed is:

1. A synchrotron apparatus comprising means for defining a loop-shaped chamber through which a beam of charged particles passes, a pair of bending magnets which bend said beam along said chamber, a pair of focusing magnets and a pair of defocusing magnets, respectively, which focus and defocus the particle beam, an RF accelerating cavity which accelerates the particle beam, and a beam-cooling high-frequency accelerating cavity means for generating an electromagnetic field of an even TM-mode number standing in a direction transverse to the particle beam so as to decrease energy dispersion of the particle beam.

2. A synchrotron apparatus as claimed in claim 1 wherein said beam cooling high-frequency accelerating cavity is disposed at a position where a dispersion function is at a maximum value in said loop-shaped chamber.

3. A synchrotron apparatus as claimed in claim 1 wherein said RF accelerating cavity comprises a fundamental-mode exciting means for exciting a fundamental-mode electromagnetic field, at least a detecting means for detecting phase and strength of respective higher-mode electromagnetic fields other than said fundamental-mode electromagnetic field by detecting an electromagnetic field in said RF accelerating cavity, and a higher-mode exciting means for exciting at least one higher-mode electromagnetic field in antiphase with and at the same strength as said detected higher-mode electromagnetic fields other than the fundamental-mode electromagnetic field in said RF accelerating cavity in accordance with the result of said detection.

4. A synchrotron apparatus as claimed in claim 3 wherein said detecting means comprises a search coil installed in said RF accelerating cavity, a filter for eliminating the fundamental-mode electromagnetic field from the detected output of said search coil, and a phase detector and a strength detector for respectively detecting phase and strength of the higher-mode electromagnetic field obtained from said filter.

5. A synchrotron apparatus as claimed in claim 3 wherein said higher-mode exciting means comprises a generator for generating a higher-mode electromagnetic field, a phase shifter means for shifting the higher-mode electromagnetic field from the generator to an opposite phase in relation to said detected phase of the phase detector, an attenuator for regulating the strength of the higher-mode electromagnetic field of said generator so as to make it equal to the detected strength of said strength detector, an infinite terminating resistor circuit for the fundamental-mode which is connected between said attenuator and said RF accelerating cavity, and an antiphase higher-mode exciting antenna installed in said RF accelerating cavity and connected to said infinite terminating resistor circuit.

* * * * *